United States Patent [19]

Isono

[11] Patent Number: 4,589,695

[45] Date of Patent: May 20, 1986

[54] VEHICLE SEAT

[75] Inventor: Hiroyuki Isono, Akishima, Japan

[73] Assignee: Tachikawa Spring Co., Ltd., Tokyo, Japan

[21] Appl. No.: 594,313

[22] Filed: Mar. 28, 1984

[51] Int. Cl.[4] ..... A47C 3/00

[52] U.S. Cl. ..... 297/284; 297/DIG. 3

[58] Field of Search ..... 297/284, DIG. 3, DIG. 1, 297/DIG. 2

[56] References Cited

U.S. PATENT DOCUMENTS

| | | | |
|---|---|---|---|
| 2,627,903 | 2/1953 | Stevenson | 297/DIG. 1 |
| 2,819,712 | 1/1958 | Morrison | 297/DIG. 1 |
| 3,680,918 | 8/1972 | Briggs | 297/DIG. 3 |
| 3,713,696 | 1/1973 | Dudley | 297/DIG. 1 |
| 3,983,640 | 10/1976 | Cardulla et al. | 297/284 |
| 4,017,118 | 4/1977 | Cawley | 297/284 |
| 4,190,286 | 2/1980 | Bentley | 297/284 |
| 4,321,044 | 3/1982 | Kron | 297/284 |
| 4,444,430 | 4/1984 | Yoshida et al. | 297/284 |
| 4,491,157 | 1/1985 | Hashimoto | 297/284 |
| 4,491,364 | 1/1985 | Hattori et al. | 297/284 |

*Primary Examiner*—Francis K. Zugel

*Attorney, Agent, or Firm*—Cushman Darby & Cushman

[57] ABSTRACT

A vehicle seat is disclosed which includes air bags therein in order to form support sections of a predetermined configuration on the surface of the seat. Within a seat pad in the seat, in particular, in its interior portions which correspond to locations where said support sections are formed, there are formed slits respectively such that these slits extend substantially parallel with the surface configurations of the respective support sections. Also, the air bags are inserted into and contained within these slits, respectively. The air bags and thus the support sections can be suitably expanded and compressed by means of an adjustment device.

9 Claims, 14 Drawing Figures

VEHICLE SEAT

BACKGROUND OF THE INVENTION

1. Field of the Invention

The present invention relates to a vehicle seat and, more particularly, to a vehicle seat which incorporates air bags therein so as to provide support portions of a predetermined form on the surface of the vehicle seat.

2. Description of the Prior Art

Conventionally, there have been proposed and practiced some vehicle seats in which air bags are employed instead of mechanical adjustment means in support sections including thigh support sections and side support sections in a seat cushion as well as lumbar support sections and side support sections in a seat back to variably adjust their forms or sitting pressures. Such air bags can be expanded or contracted by means of feed-in or discharge of air so as to adjust the forms and sitting pressures of these support sections, respectively.

Examples of the conventional seats of this type in which air bags are included are those shown in FIGS. 1, 2 and 3.

Specifically, FIG. 1 illustrates a centrally longitudinal section view of a seat back forming a part of an example of the conventional seats provided with air bags therein, and FIG. 2 shows a transverse cross section view taken along line I—I in FIG. 1. As shown in these figures, in this seat back (1) there are provided air bags (4) and (5) between a seat pad (6) and a top member (7) such that they are located at a lumbar support section (2) and at side support sections (3)(3), respectively.

With such structure, however, when air is fed into the air bags (4) and (5) so as to expand them and thus operate the support sections (2) and (3),(3), actually, the support sections (2) and (3)(3) can not be expanded outwardly so much. This is because the expansion of the air bags (4) and (5) is restricted by the general tension force of the top member (7) extended over the seat so that the seat pad (6) between a seat frame (8) and the air bags (4)(5) is compressed. Such structure also presents another problem. Since the expansion forces of the air bags (4) and (5) are applied directly to the top member (7), respective support sections (2) and (3)(3) are locally expanded and the air pressure is applied via the top member (7) directly to an occupant of the seat so that the occupant may be given a strange feeling.

Next, another example of the prior art seat of this type is described with reference to FIG. 3, which is similar to FIG. 1, that is, a longitudinally sectional side view of a seat back portion of the seat. In FIG. 3, reference (9) designates an air bag.

The air bag (9) of this prior art seat, as shown in FIG. 1, is mounted onto the surface of a top member (7). In this case, since the expansion force of the air bag (9) is directed directly to the occupant when it is expanded, its extension effects due to its expansion may not be reduced as in the conventional seat in FIG. 1, but the air bag (9) will give the occupant a substantially greater stange feeling. The reason why such greater strange feeling is produced is the fact that since the air bag (9) is in direct contact with the occupant it is expanded toward its portions where a smaller sitting pressure is applied between the occupant's back and the seat back so that its remaining portions suffering from a larger sitting pressure are given away, that is, the air bag (9) is not expanded little at its portions where supporting is most needed or the highest sitting pressure is applied so that it is extended out at its portions where no supporting effects are required only. In addition, since the occupant is sitting via the air bag against the seat back during running of the vehicle, the occupant may be easily vibrated by means of the air pressure of the air bag when the vehicle is vibrated, which makes the occupant unstable and uncomfortable during sitting.

SUMMARY OF THE INVENTION

Accordingly, a primary object of the present invention is to provide an improved vehicle seat which can overcome the above-mentioned drawbacks in the prior art seat.

In accomplishing this object, in one aspect of the invention, there are formed several slits at locations within a seat pad which respectively correspond to those of various support sections such as a thigh support section, side support sections and a lumbar support section and air bags are received within these slits, respectively. According to this embodiment of the invention, the support sections of a predetermined form can be provided on the side of a seat surface so that the expansion effects of the air bags can be used more efficiently as well as that the above-mentioned strange feeling of the occupant can also be avoided.

In another aspect of the invention, the air bags can be positioned for fixation thereof to the seat pad simply by inserting them within the slits of the seat pad, which can eliminate the need for a complicated operation and thus can improve a working efficiency in assembling a seat.

A related object of the invention is to provide a structure of an adjustment device for adjusting the expansion and contraction of the air bags respectively inserted within their associated slits and a method for controlling thereof.

According to this structure, the respective support sections of the seat can be controlled collectively. Specifically, air can be fed into and discharged out of all air bags simultaneously, or, each of the air bags can be air charged and discharged individually. With this structure, therefore, it is possible to retain the respective support sections in such forms and sitting pressures as suitable for the particular physique and preference of the occupant, permitting the occupant to take a comfortable attitude.

Since such slits are formed in a relationship substantially parallel with the configurations of the seat surface located thereabove, the air bags can be uniformly expanded and contracted with respect to the surface sides of the respective support sections. Thus, according to the invention, the air bags will never give the occupant such a strange feeling as in the conventional ones since the air bags of the invention will not be expanded locally.

DETAILED DESCRIPTION OF PREFERRED EMBODIMENTS OF THE INVENTION

Figure 1:
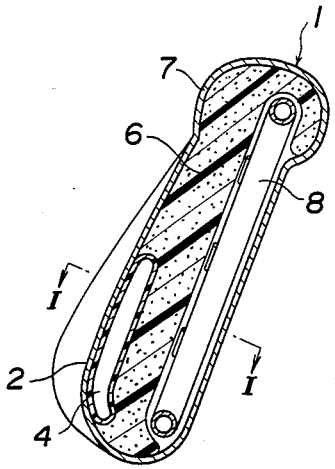
FIG. 1 is a control, longitudinal sectional view of a seat back of a conventional vehicle seat of the type including air bags therein.
Figure 2:
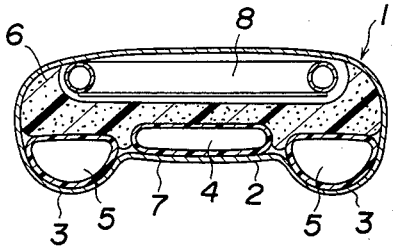
FIG. 2 is a transverse sectional view taken along line I—I in FIG. 1.
Figure 3:
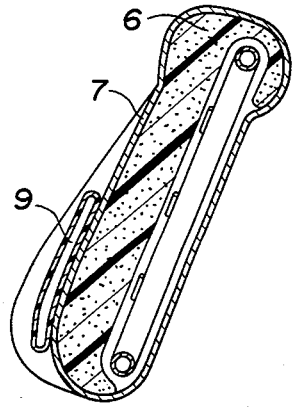
FIG. 3 is a side view of another conventional vehicle seat, illustrating the seat back of the seat in a longitudinal sectional view.
Figure 4:
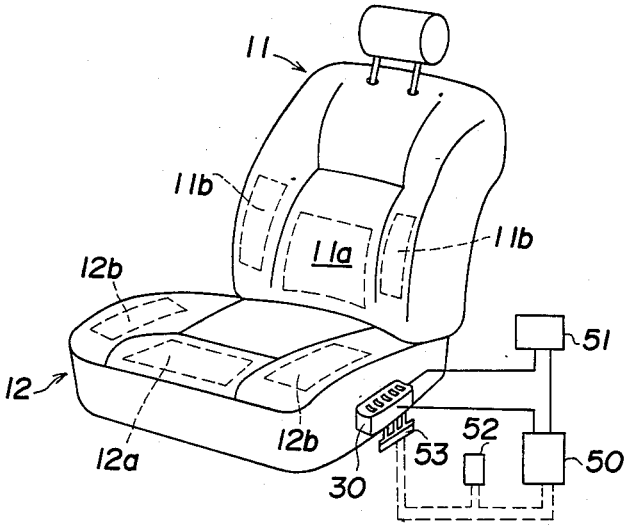
FIG. 4 is a perspective view of a vehicle seat constructed in accordance with the invention, illustrating the outline thereof.

FIG. 4 illustrates an outline of an embodiment of the vehicle seat constructed in accordance with the invention. In this figure, reference numerals (11),(11*a*) and (11*b*) designate a seat back, a lumbar support section and side support sections, respectively. Similarly, (12),(12*a*) and (12*b*) represent a seat cushion, a thigh support section and side support sections, respectively. The seat of the invention is so constructed that it can adjust the sitting position of an occupant by means of these support sections as necessary.

Figure 9:
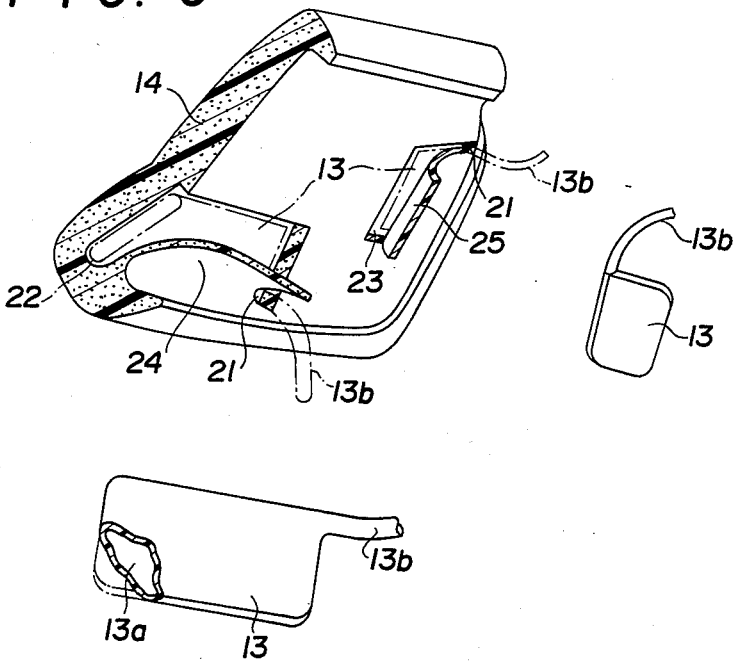
FIG. 9 is an explanatory view of another embodiment of the seat cushion portion of the invention, illustrating its state with one vertical half section cut away therefrom and seen diagonally from below.

Each of the support sections contains an air bag (13) therein and this air bag (13), as an example thereof is shown in FIG. 9, comprises a substantially rectangularly-shaped, flat air-tight bag and has an air chamber (13*a*) which is connected in communication with an air hose (13*b*). Air can be charged into and discharged from the air bag (13) by means of this air hose (13*b*) to expand and contract it. Since it is preferred to expand the air bag (13) while maintaining its rectangular parallelpiped form in supporting the occupant, the air bag (13) may be provided on its peripheral side surfaces with bellows or the like.

Other air bags employed in the embodiments of the invention are substantially similar to the above-mentioned air bag (13) in structure and form, although they may differ from it in size to some degrees depending upon their respective locations of use.

From now, we will describe these embodiments of the invention by parts in detail.

Figure 5:
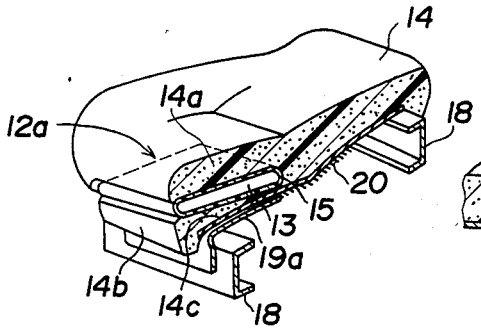
FIG. 5 is a longitudinally sectional perspective view of an embodiment of a thigh support section with a top member of a seat cushion being removed.

FIG. 5 is a longitudinally sectional, perspective view of the seat cushion (12) with the top member being removed therefrom, illustrating an embodiment of a thigh support (12*a*). In this figure, reference numeral (14) designates a seat pad forming a part of the seat cushion (12). This seat pad (14) is formed in its front portion with a slit (15) open to the front side of the seat along a plane substantially parallel with the surface configuration of the thigh support section (12*a*) which is adapted to support the femoral region of an occupant, and this slit (15) can receive the above-mentioned air bag (13) therein to form the thigh support section (12*a*).

Since the slit (15) is provided for purposes of accomodating the air bag (13), it is formed in a rectangular parallelpiped so as to suit the outside shape of the air bag (13).

In order to avoid a strange feeling in sitting when the air bag (13) is expanded, the slit (15) is preferrably located below the intermediate position of the thickness of the seat pad (14).

In this embodiment, the seat pad (14) has an upper surface portion (14*a*) which is larger in thickness than a lower surface portion (14*b*) with respect to the slit (15). This thickness relationship is provided similarly in other slits (16),(17) as well, which slits will be described later.

Pad support (14*c*) of a loose wool felt or the like is integrally applied and adhered throughout the entire lower surface of the seat pad (14) to protect the seat pad (14) from the sharpened corners of a seat frame (18).

Figure 8:
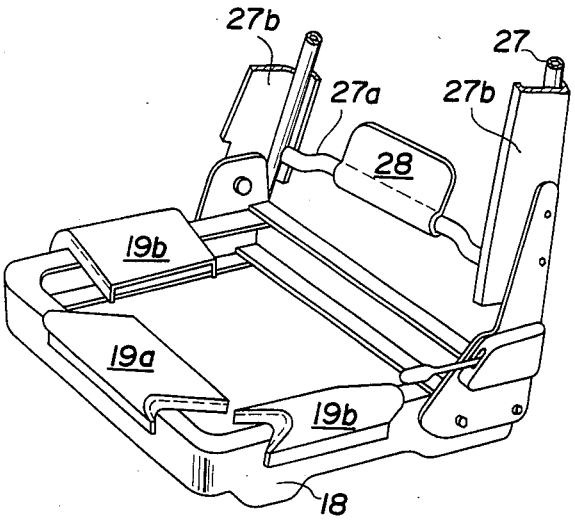
FIG. 8 is a perspective view of a portion of a seat frame having supoort plates fixed thereto.

On the other hand, there is fixed to the front side portion a support plate (19*a*) as shown in FIG. 8 which is bent in such a manner as to form a plane substantially parallel to the surface configuration of the thigh support section (12*a*). This support plate (19*a*) serves to support the front lower surface of the seat pad (14) or the lower side of the slit (15).

Support plate (19*a*) is also turned down at its both sides at right angles for reinforcement against loads applied from above.

To fix this support plate (19*a*) to the seat frame (18), as shown in FIG. 8, the bent portions of the support plate (19*a*) at both sides of its end to be fixed are first cut away, then these end side surfaces are brought into close contact with the side wall of the seat frame (18), and finally such end side surfaces are fixed to the seat frame side wall by welding or the like.

Figure 6:
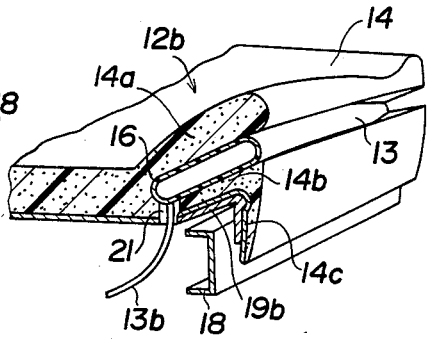
FIG. 6 is a transversely sectional perspective view of a portion of a side support section of the invention with a top member of a seat cushion removed.

Next, we will describe embodiments of side supports (12*b*)(12*b*) with reference to FIG. 6. FIG. 6 is a transversely sectional, perspective view of a portion of the seat cushion (12) with its top member being removed therefrom, illustrating one of the side support sections, that is, the right-hand side support section (12*b*) only. As the other side support section is arranged symmetrically in the same structure as this, it will not be shown or described here separately.

This side support section (12*b*) is constructed by forming a slit (16) in the seat pad (14) in the same manner as with the above-mentioned slit (15) in the side support section (12*a*) such that it extends along a plane substantially parallel with the surface of the side support section (12*b*) and is open to the right side of the seat, and then by inserting an air bag (13) within this slit (16). The side support section (12*b*), as with the above-mentioned side support sections (12*a*), is also supported at its lower surface portion (14*b*) via a pad support (14*c*) by a support plate (19*b*) which is so bent as to form a plane substantially parallel to the surface configuration of the side support section (12*b*) and is fixed to the side frame portion of the seat frame (18).

The thus arranged seat pad (14) is mounted onto the seat frame (18) such that it is supported from below by a plurality of support plates (19*a*) and (19*b*) which are so provided as to correspond to the side support sections (12*a*) and (12*b*) as well as by a pad holder (20).

The lower surface portions (14*b*) of the slits (15) and (16) in the seat pad (14) which respectively correspond to the side support sections (12*a*) and (12*b*) may be composed of the pad support (14*c*) only.

Such slits (15) and (16) for the side support sections (12*a*) and (12*b*) in the seat pad (14) may be substituted by other embodiments such as slotted slits (22), (23) as shown in FIG. 9. These slits (22) and (23) in the seat pad (14) illustrated in FIG. 9 may be formed in the interiors of cover-like cutout surface portions (24) and (25) which have been previously provided in the seat pad (14) by cutting the lower surface side of the seat pad (14) in a U-shaped form. Air bags (13) can be inserted into and removed from these slits (22) and (23) by opening and closing the cutout surface portions (24) and (25), respectively. In formation of these slits (22) and (23), the cutout surface portions (24) and (25) can also be formed from the surface side of the seat pad (14).

Figure 7:
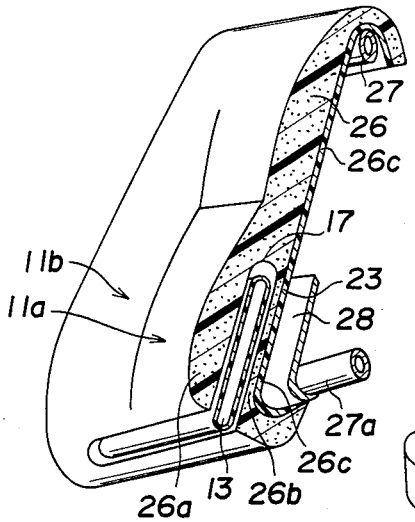
FIG. 7 is a longitudinally sectional perspective view of a lumbar support section in accordance with the invention with a top member of a seat back being removed therefrom.

Now, we will describe the support sections provided in the seat back (11) with reference to FIG. 7.

FIG. 7 is a longitudinally sectional, perspective view of the seat back (11) with its top member being removed therefrom, illustrating a lumbar support section (11*a*). Since side support sections in the seat back (11) can be provided in a manner similar to the side support sections (12*b*) in the seat cushion (12), only the lumbar support section (11*a*) will be explained here.

Such lumbar support section (11*a*), is constructed by forming a slit (17) in the central lower portion of the seat pad (26) by means of slotting it from below and then by inserting the air bag (13) within this slit (17).

As with the above-mentioned slits (15),(16) in the seat cushion (12), slit (17) is located between the front surface portion (26*a*) and rear surface portion (26*b*) of the seat pad (26) and is arranged to form a plane substantially parallel with the surface configuration of the lumbar support section (11*a*). Again in this case, the rear surface portion (26*b*) of the slit (17) may be composed of only a pad support (26*c*) glued to the rear surface of the seat pad (26). This is because the integral structure of the seat pad (26) and the pad support (26*c*) provides no obstacle in forming the slit (17).

On the other hand, a support plate (28) is fixed to the lower frame portion of the back frame (27*a*), and, with the seat pad (26) being mounted to the back frame (27*a*), the rear surface portion (26*b*) of the slit (17) is abutted against and supported by the support plate (28).

Support plate (28), which supports the slit rear surface portion (26*b*) in the above-mentioned manner, is arranged in a flat plate form as shown in FIG. 8, and its lower end is wound around the lower frame portion (27*a*) of the back frame (27) and is fixed thereto by welding or other suitable means. A support plate for supporting the slit rear surface portion of the side support section (11*b*) will be fixed to the side bracket (27*b*) of the back frame, although it is not shown in this figure.

As shown in FIGS. 6 and 9, each of slits (15),(16) and (17), which are respectively so arranged as to correspond to the respective support sections in the above-mentioned seat pads (14) and (26), is formed in its back corner with a through-bore (21) which is open to the lower surface or rear surface thereof, so that the air hose (13*b*) of the air bag (13) to be contained within each slit can be guided out.

Alternatively, the lower and rear surface portions (14*b*) and (26*b*) of the respective slits (15),(16) and (17) may be formed integrally with the seat pads (14) and (26) so as to protect the air bag (13) from the frame side, or may be formed of other buffer materials than the above-mentioned pad supports (14*c*) and (26*c*). In addition, these surface portions may be formed of rigid materials instead of the above-described buffer materials, which can eliminate the need to fix the support plates (19*a*),(19*b*) and (28) to the frame (18) and (27*a*).

The expansion and compression of each air bag (13) inserted within its associated slit as has been described in detail can be adjustably controlled by an adjustment device (30) that can controllably charge and discharge compressed air into and from its air chamber (13*a*) by means of its associated air hose (13*b*) communicating with the air bag (13) in an individual manner.

As described hereinbefore, according to the invention, in a seat wherein the forms and sitting pressures of its respective support sections can be adjusted by expanding and compressing their associated air bags, the air bags are inserted within the seat pad of the seat, in particular, within their associated slits which are respectively formed in the seat pad in a manner to correspond to their associated support sections as well as to be substantially parallel to the surface configurations of the associated support sections, whereby the expansion and compression of the respective air bags can be performed uniformly with respect to the front surfaces of the respective support sections and also can provide almost the same touch as that of the seat pad. This eliminates the disadvantages seen in the prior art seat: for example, the air bags are locally expanded to give the occupant a strange touch; or, the air bags are expanded little so that the respective support sections can not have a predetermined raised configuration. In other words, the seat of the invention can retain its respective support sections in their forms and sitting pressures suitable for the physical conditions and preferences of the occupants, permitting the occupants to take their comfortable attitude.

In assembling the seat of the invention, the air bags can be positioned for its fixation to the seat pad simply by inserting them within their associated slits formed in the seat pad, which eliminates the need for a complicated positioning operation and also improves a working efficiency.

We will now describe the structure of the above-mentioned adjustment device and a method for controlling it with reference to FIGS. 10 to 14.

Figure 10:
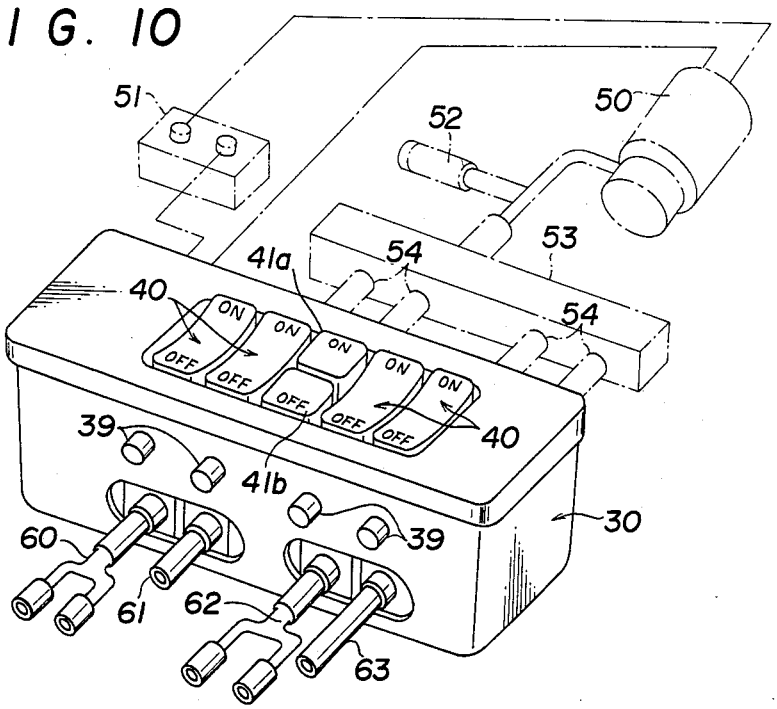
FIG. 10 is a perspective view of a general control mechanism for controlling the support sections of the invention and thus the air bags of the invention in which an adjustment device for adjusting the expansion and contraction of the air bags is included.
Figure 11:
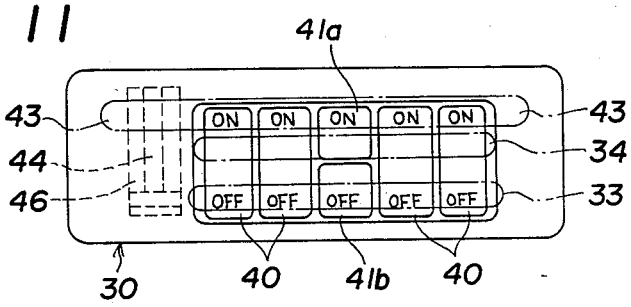
FIG. 11 is a plan view of the adjustment device in FIG. 10.

FIG. 10 illustrates a perspective view of an outline of a control mechanism for controlling the support sections of the present seat, including the above-mentioned adjustment device (30).

This adjustment device (30) is constructed such that it can control the seat support sections collectively and that it can perform the opening/closing of fluid valves for charging/discharging of air as well as on/off of a power source for an air pump (50) by means of one-touch operation. Specifically, if the adjustment device (30) closes a circuit connecting the power source (51) with the air pump (50), then the air pump (50) is activated to feed out compressed air. This compressed air is first controlled by a relief valve (52) so that it will not produce an overpressure, and then is fed via a branch joint (53) into the adjustment device (30), which charge the compressed air into the respective air bags (13) in their associated support sections individually by means of the respective air hoses (60, 61, 62, 63).

Figure 12:
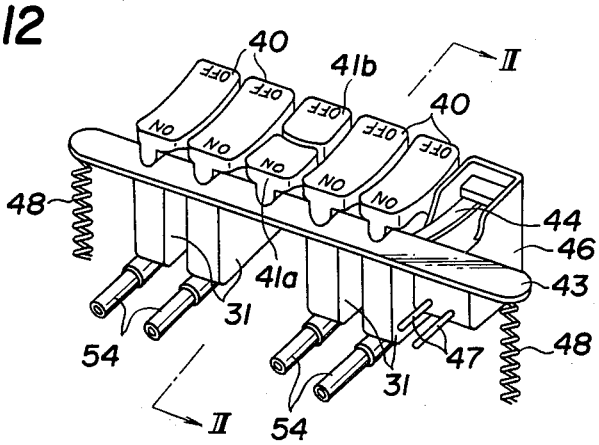
FIG. 12 is a perspective view of the main portions of the adjustment device.

Next, the structure of this adjustment device (30) will be described. The adjustment device (30) is provided with switches (31) which respectively correspond to the respective air bags in the seat directly, a whole air-feed switch (41*a*) which is operable to feed air to all air bags and at the same time to apply an input to the air pump (50), and a whole exhaust switch (41*b*) operable to exhaust the air from all air bags. The main portions of the switches (31) are taken out from the adjustment device (30) and are shown in FIG. 12. As can be seen from FIG. 12, the respective switches (31), which feed and exhaust air to and from the respective air bags individually, include feed/exhaust valve means respectively which are independent of each other. These switches are also cooperatively connected with an auxiliary push plate (43) operable to switch a power switch (46) of the air pump (50).

Then, the structure of each of the switches (31) will be explained with reference to FIG. 13 which is drawn as a cross-sectional side view taken along line II—II in FIG. 12.

Figure 13:
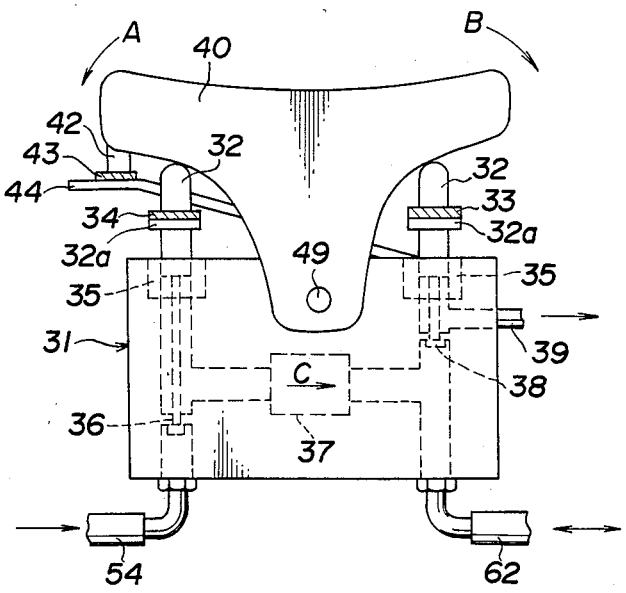
FIG. 13 is a sectional side view taken along line II—II in FIG. 12, illustrating the switch portions of the adjustment device; and, FIG. 14 is an exploded, perspective view of the main portions of the adjustment device.

FIG. 13 is a side view of the switch (31), as described above. There are connected to the body of this switch an air introduction hose (54) and an air hose (62) which are in turn connected in communication with their associated internally-built-in switch valves.

Air introduction hose (54) which introduces the compressed air from the air pump is threaded to the intake portion in the lower portion of the switch body. Switch valve (36) provided in the upper portion of this intake is normally closed to prevent introduction of the compressed air. In the illustrated embodiment of the invention, the adjustment device (30) includes four sets of such switches (31) as described above.

Referring now to FIG. 10, a left-most switch (31) is a switch that adjusts the side support sections in the seat back portion of the seat and this switch is connected to an air hose (60) which is in turn branched into two fork ends being communicatively connected with the respective air hoses (13*b*) for a pair of air bags (13) within the associated side support sections. Since the air hose (60) is branched between a check valve (37) for the switch to be described later and the air bags (13) so that the air pressure within said pair of air bags (13) can be maintained constant, both air bags (13) can provide a balanced support for the occupant from both sides.

Air hose (61), which is connected with the second left-most switch (31), is connected to the air hose (13*b*) for the air bag (13) within the lumbar support section (11*a*) and conducts air directly. A pair of switches (41*a*),(41*b*), which are arranged in the third place from left, can perform a simultaneous adjustment of air feed and exhaust of all air bags (13) and they themselves are not connected to any air hoses.

Another switch (31), which is arranged in the fourth place from left, is connected with an air hose (62). This air hose (62), as with the above-mentioned air hose (60) for the air bags contained within the side support sections (11*b*) in the seat back, is branched to two fork portions which are respectively connected to the associated air hoses (13*b*) for a pair of air bags (13) inserted in the side support sections (12*b*) of the seat cushion (12) in such a relationship as to conduct the compressed air to and from the latter air hoses. Finally, a right-most switch (31) has an air hose (63) connected thereto, which is in turn connected to the air hose (13*b*) within the air bag (13) in the thigh support section.

For example, when the occupant wants to expand the side support sections (12*b*, 12*b*) in the seat cushion (12) of the seat, he or she has only to depress a switch button (40) in the direction of an arrow A, which button is supported by means of a shaft (49) on the upper portion of the switch body in a manner to be free to rock. Specifically, when the switch button is depressed, a push button (32) being abutted against its lower portion is pushed down to open a switch valve (36) cooperatively connected with this push button (32), so that the compressed air will be introduced into the switch body.

The push button (32) is provided at the intermediate position of its push rod portion with a flange (32*a*) so as to prevent the push button itself from being pushed down beyond a predetermined depth. The push button (32) is also provided in its lower portion located within the switch body with a connection device (35) connected to the switch valve (36), which device serves to maintain an air-tight condition so as to prevent the compressed air introduced from the switch valve (36) from escaping through a clearance formed between the push button (32) and also serves to push up the push button (32) depressibly to a predetermined position using a spring or the like.

The compressed air that has passed through the opened switch valve (36) flows through the check valve (37) in the direction of an arrow C along a conduit line within the switch body, then passes through the air hose (62) which is branched to its two fork portions respectively communicating with their associated air bags, and finally is charged into the respective side support sections (12*b*, 12*b*) in the seat cushion, or, exactly into the air bags contained within the side support sections (12*b*, 12*b*).

During this air supply, the air pump (50) is simultaneously driven to feed the compressed air so as to continue such air supply. This is because during such air supply state the switch button (40) being depressed in the direction of the arrow A causes a projection (42) provided in its ON-side end to push down the push plate (43).

Both plate (43) has both ends resiliently supported by the respective springs (48),(48), as shown in FIG. 12, and is lowered as the switch button (40) is depressed in the direction of the arrow A. The resiliency of these support springs (48),(48) can be adjusted to facilitate depression of the switch button.

Push plate (43) also serves to press down a switch bar (44) in a manner to place the switch bar under itself which is projected from the power switch (46) for the air pump (50) placed in juxtaposition with the switch (40).

Figure 14:
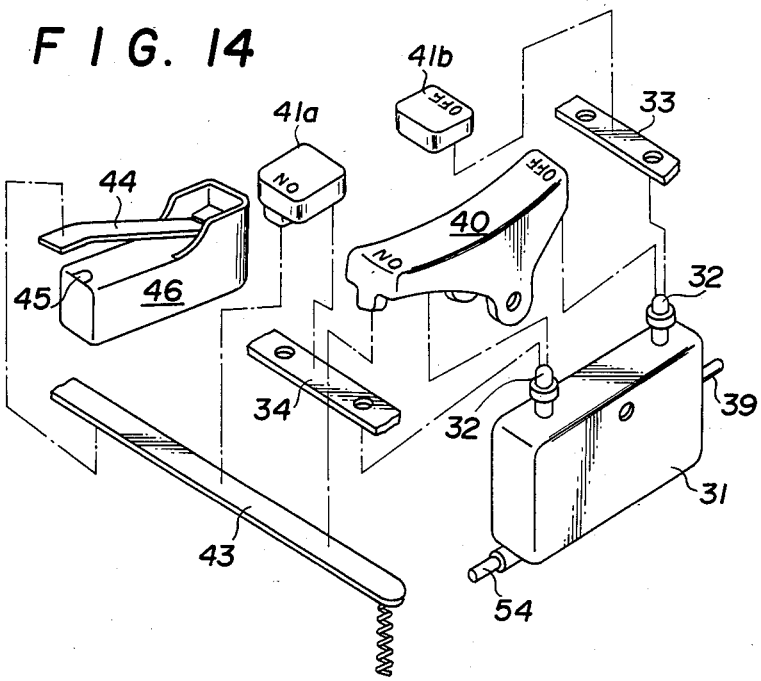

Switch bar (44), when pressed down, comes in contact with an electrode terminal (45) as shown in FIG. 14 to be energized, so that the air pump (50) is driven to keep on air supply into the air bags (13). This air supply state is continued while the switch button (40) is being depressed.

When a desired air supply to the air bag (13) has been completed, release of the switch button (40) stops such air supply. In this condition, the air supply valve (36) is closed and the air pump switch (46) is also switched off. Further, since the check valve (37) is activated, the air contained within the air bag (13) is prevented from flowing backward and the air pressure within the air bag (13) is maintained constant.

To exhaust or discharge the air contained within the air bag (13) therefrom, the switch button (40) is depressed in the direction of an arrow B. This depression of the switch button (40) pushes down the push button (32) to open an exhaust switch valve (38), so that the air within the air bag (13) will flow backwardly through the air hose and will be discharged via an exhaust port (39) into the open air.

The push button (32) is also provided with a flange (32*a*) for prevention of its over-depression as well as with the same connection device (35) as described before between the exhaust switch valve, as with the above-mentioned push button (32) for air supply.

As the switch (31) for connection with the respective air bags (13) has been described above in detail, we will next explain about the switch (41*a*) for simultaneous air supply to all air bags (13) and the switch (41*b*) to discharge simultaneously the air contained within all air bags therefrom.

These two switches that respectively supply and discharge the air to and from all air bags are adapted to operate all switches mechanically at the same time which respectively actuate each of the above-mentioned air bags. Specifically, the switches (41*a*) and (41*b*) can be operated by depressing the push plate (43) and cross plates designated by numerals (33), (34) in FIG. 11 which illustrates a plan view of the adjustment device (30).

One of the cross plates (33) is suitably formed with a plurality of round bores into which every head projections of the push buttons (32) of the exhaust valves aligned are fitted—one projection for each bore—so that the cross plate (33) is placed on the flanges (32*a*) of these push buttons (32). On the other hand, the other cross plate (34) is similarly formed with a plurality of round bores into which the alighned push buttons (32) of the air supply valves are fitted in the same manner as with one cross plate (33) so that the cross plate (34) is disposed on the associated push button flanges (32*a*).

This cross plate (33) for the exhaust valves can be depressed by means of the smaller-sized push button (41*b*) mounted centrally among the juxtaposed switch buttons. If this whole exhaust push button (41*b*) is depressed, then the buttons (32) of the exhaust valves of all switches (31) are pushed down by means of the cross plate (33) so that the air can be exhausted from all air bags (13) simultaneously.

Also, the whole air supply push button (41*a*) is mounted in juxtaposition with the above-mentioned whole exhaust push button (41*a*) so that it can be operated to push down both of the cross plate (34) for the air supply valves and the push plate (43) to drive the above-mentioned air pump simultaneously.

If the whole air supply push button (41*a*) is depressed, then the air supply push buttons (32) are pushed down by means of the cross plate (34) and at the same time the push plate (43) is depressed, so that the air supply valves (36) are opened and at the same time the air pump (50) is actuated to supply the compressed air to all of the air bags (13).

According to the invention, since the adjustment device (30) is arranged in the above-mentioned manner, the occupant is able to adjust his or her sitting attitude as desired by operating each of the switch buttons (40, 41*a*, 41*b*).

What is claimed is:

1. A vehicle seat of the type having pneumatically adjustable support regions comprising:

a seat frame including plural frame members which together bound an interior area;

at least one cushion member positioned in said interior area and supported by means of said seat frame, said cushion member having opposing pairs of side portions of a predetermined thickness which peripherally bound an upper support surface for supporting a seat occupant and a lower surface; wherein predetermined ones of said side portions integrally include slitdefining means for defining at least one slit having an outer end opened to an exterior of said cushion member and a closed inner end spaced from said outer end and located interiorly of said cushion member, said slit extending between said outer and inner ends substantially parallel to said support surface of said cushion member subjeacent to an area of said support surface which is desired to be pneumatically adjustable, said slit-defining means for separating said cushion member into upper and lower portions which are in registry with said adjustable area of said upper surface; air bag means inserted into said at least one slit and being expansible upon introduction of pressurized air so as to responsively cause said upper portion of said cushion member to be displaced relative to said lower portion of said cushion member thereby adjusting said adjustable area of said support surface, and wherein said seat frame also includes plural support plates subjacently supporting said cushion member, each having one end fixed to a respective frame member and another free end which is positioned in said interior area such that each said support plate is extended into and terminates within said interior area so that said lower surface of said cushion member is in contact with and is supported by said plural support plates such that one of said support plates is in registry with said at least one slit and thus in registry with said support surface area.

2. A vehicle seat as in claim 1 wherein said at least one slit is formed in a substantially rectangular parallelpiped shape.

3. A vehicle seat as in claim 1 wherein said at least one slit is located below a center position of said cushion member in its thickness direction.

4. A vehicle seat as in claim 1 wherein said slit-defining means defines a plurality of slits corresponding to at least a thigh support region, a side support region, and a lumbar support region.

5. A vehicle seat as in claim 1 further comprising expansion control means in fluid communication with said air bag means for controlling the amount of expansion of said air bag means and thus the amount of support adjustment of said adjustable area of said support surface.

6. A vehicle seat as in claim 5 wherein said expansion control means includes a source of said pressurized air and manually-operable switch means for selectively supplying said pressurized air from said source thereof to said air bag means and for selectively exhausting said supplied pressurized air from said air bag means.

7. A vehicle seat as in claim 1 wherein said slit defining means defines a plurality of said slits each corresponding to a predetermined said adjustable area of said support surface, and wherein each said slit includes one of a plurality of said air bag means inserted therein.

8. A vehicle seat as in claim 7 wherein said air bag means include air hoses and expansion adjustment means connected to said air hoses for controlling supply of compressed air to and from said air bag means.

9. A vehicle seat as in claim 8, wherein said expansion adjustment means includes individual switch means each directly corresponding to one of said air bag means so that compressed air can be individually supplied to selected predetermined ones of said air bag means, collective air supply switch means operable to supply said compressed air simultaneously to all of said air bag means, and collective exhaust switch means operable to exhaust said supplied compressed air simultaneously from all of said air bag means.

* * * * *